US007260545B1

(12) United States Patent
Schaer et al.

(10) Patent No.: US 7,260,545 B1
(45) Date of Patent: Aug. 21, 2007

(54) SYSTEM AND METHOD FOR SELECTION OF CROSS-COUNTRY SKIS

(75) Inventors: Rolf Schaer, Etna, NH (US); Steve Kvinlaug, Quechee, VT (US)

(73) Assignee: Alpina Sports Corporation, Hanover, NH (US)

( * ) Notice: Subject to any disclaimer, the term of this patent is extended or adjusted under 35 U.S.C. 154(b) by 374 days.

(21) Appl. No.: 10/003,738

(22) Filed: Nov. 15, 2001

Related U.S. Application Data

(60) Provisional application No. 60/249,414, filed on Nov. 15, 2000.

(51) Int. Cl.
*G06Q 99/00* (2006.01)

(52) U.S. Cl. ..... 705/1

(58) Field of Classification Search ..... 705/1; 177/169, 173, 264
See application file for complete search history.

(56) References Cited

U.S. PATENT DOCUMENTS 3,910,366 A * 10/1975 Terraillon ..... 177/225
3,922,908 A 12/1975 Stemsrud et al. ..... 73/100
4,164,875 A 8/1979 Kantar et al. ..... 73/812
4,926,885 A 5/1990 Hinkle ..... 128/898
5,123,494 A * 6/1992 Schneider ..... 177/50
5,157,601 A * 10/1992 Jones et al. ..... 600/300

FOREIGN PATENT DOCUMENTS

WO WO79/00207 * 4/1979

OTHER PUBLICATIONS

Yucca Dune ski sizing chart, www.yuccadune.com, Apr. 1999, 3 pages.*
Two racing ski order forms of Alpina Sports Corporation.

* cited by examiner

*Primary Examiner*—Dennis Ruhl
(74) *Attorney, Agent, or Firm*—Black Lowe & Graham, PLLC

(57) ABSTRACT

A system for selecting skis accesses the weight of a user without disclosing the weight, then assigns the weight into one of several predefined weight ranges. Encrypted weight indicators are provided which are each distinctive to a particular weight range, and the appropriate weight indicator for the weight range into which the weight of the user is assigned is provided. A set of distinct indicia that match the weight indicators are applied to a collection of skis. The skis are divided into groups, each group being designed to be suitable for users having any weight within a particular one of the weight ranges. The skis in a particular group are marked with the indicia which match the weight indicator for that particular weight range. By selecting skis having indicia that match the weight indicator provided, the user selects skis which are suitable based on the weight of the user.

10 Claims, 7 Drawing Sheets

SYSTEM AND METHOD FOR SELECTION OF CROSS-COUNTRY SKIS

FIELD OF THE INVENTION

The present invention provides a system and method which allow users to readily select appropriate cross-country skis based on the weight of the user without requiring public disclosure of their weight.

BACKGROUND OF THE INVENTION

In cross-country skiing, the skis are subject to two distinct actions, a kick action and a glide action. To better understand how these actions are implemented, one must understand the basic structure of the cross-country ski. Cross-country skis have an arched bottom surface with a central gripping portion that is textured or otherwise treated to grip the snow surface when brought into contact with the snow. The arch or camber of each ski is designed to maintain the gripping portion of the bottom surface above the snow surface during the glide action, where the weight of the user is well distributed between both skis and the skis are simply supporting the user on the snow surface. When the gripping portions of the bottom surfaces of the skis are raised above the snow surface, the gripping portions do not engage the snow surface, allowing the skier to glide on the surface of the snow. During the kick action, the user distributes his/her weight such that it is primarily on one ski (a first ski) which provides an additional downwards load or force on the first ski. This increased force reduces the camber and brings the gripping portion into contact with the snow surface. When the gripping portion of the first ski, bearing a substantial portion of the weight of the user, is engaged with the snow surface, the user moves his/her body relative to the first ski to impart forward motion of a second ski across the snow.

Thus, the kick action empowers the user to impart forward propulsion and the glide action controls the distance traversed by the user in response to the kick action. Classically, the selection of cross-country skis has considered both actions important in the selection of skis for a user. Accordingly, the selection process has attempted to match the height and weight of the user with the length and stiffness of the skis, as has been done with down hill ski selection.

One method of refining the ski selection after the preliminary selection has been made based generally on the height and weight of the user is to conduct a paper test. In this test, the intended user stands on the skis with a piece of paper held under the gripping portion. If the paper can be removed, then the user can be sure that the gripping portion is raised. While this test has been used, it is most easily conducted and usually provides more reproducible results when the paper is manipulated by a fitter rather than by the user, and thus cannot be effectively performed by the user alone. Furthermore, this test does not provide an indication of whether the user will be able to deflect the skis sufficiently during the kick portion of the skiing action. For more experienced skiers or with the assistance of a ski fitter, it may be possible for the skier to simulate the user's kick action by the appropriate shifting of his/her weight while a ski fitter tries to remove the paper during this simulated kick action. However, this requires experience on the part of the skier and a ski fitter to assist.

U.S. Pat. No. 3,922,908 teaches a device which helps to better quantify the characteristics of skis without requiring the skis to be fitted directly to the skier. The device does so by applying a load to a ski and measuring the resulting pressure distribution along a baseplate on which the ski rests. By matching the load applied to the ski to the loads which would be applied by the intended user during the kick action and the glide action, the resulting performance characteristic of the ski can be predicted. The testing device is complex and provides a recording curve which requires some degree of technical expertise to interpret, as well as requiring knowledge of or accurate estimation of the forces imparted by the intended skier. These requirements would appear to severely limit the practical applications of the device.

The problem of determining the appropriate ski loads or forces generated by a skier has been addressed by U.S. Pat. No. 4,164,875, which teaches a ski testing device that includes a scale for weighing the intended user. This device can measure the load required to obtain a certain degree of flatness in the ski being tested, or can measure the degree of deflection of the ski which results from applying a certain load. While this device does have the capacity to weigh the skier, it still requires the qualification of individual skis to the person weighed. While this device appears to have more practical use than that of the '908 patent, it is still limited in that it is complex and requires a trained operator. Furthermore, the patent also teaches the importance of considering both the height and the weight of the skier when making a ski selection. Here again the skis to be tested for suitability are preselected for the user based on matching the ski length to the height and weight of the user, and then tested based on the weight of the user.

A severe limitation of the above referenced techniques is that they do not guide a user in selecting a particular pair of skis, but rather require expert assistance and rely on a trial-and-error approach to determine whether a particular ski or pair of skis is suitable for a user. This trial-and-error approach, in addition to being extremely time consuming, may also be frustrating for users, particularly those who are inexperienced.

The importance of weight as a significant factor in the selection of appropriate skis has been appreciated by the racing community, and some racing skis now have imprinted thereon, in addition to the ski length, suggested weight ranges to help remind the racer that this factor should be considered in addition to stiffness when selecting a ski. It should be apparent from ordering practices that weight, although significant, is not the controlling factor in selecting skis. Racing skis are currently ordered based on length, weight and stiffness. A skier having a weight in a particular range may have three different ski lengths recommended, each length corresponding to a particular relative degree of stiffness. While such markings have been useful for skiers having sufficient experience to judge what relative degree of stiffness they desire, such markings have not been employed for skis intended for less experienced users, who lack the experience to properly select a particular degree of stiffness. Furthermore, even the expert racer may wish to refine the selection process with the paper test discussed above.

A further limitation of such suggested weight ranges is that many users, and frequently users who are not particularly athletic, are reluctant to reveal their weight in a setting such as a retail store or a rental agency. The hesitancy of many users to disclose their correct weight is frequently so great that, if requested to publicly disclose their weight, some users may either decide not to proceed with selecting skis or, alternatively, may misrepresent their weight by underestimating it. In the latter case, the user may underestimate his or her weight to an extent that the user selects skis which will not properly function in the glide mode when the actual weight of the user is minimized on the individual skis by distributing the weight equally between the skis. For example, if a user having an actual weight of 150 lbs. (68 kg) selects skis based on a misrepresented weight of 100 lbs. (45 kg), each of the skis so selected is designed to glide, properly under a load of 50 lbs. (23 kg). The 150 lbs. (68 kg) user cannot apply only 50 lbs. (23 kg) to each ski, and thus will not experience proper performance in the glide mode.

Similarly, the staff in stores or rental agencies may be reluctant to ask for the weight of a user. More experienced staff frequently estimate the height and weight of a user visually in order to select skis to avoid asking the user. This approach requires considerable experience to employ effectively, and even then is of questionable accuracy.

Thus, there is a need for a simple system and method for allowing users, particularly inexperienced users, to readily select appropriate skis to suit the weight of the user. There is also a need for a system and method for allowing users to select appropriate skis without having the weight of the user revealed.

SUMMARY OF THE INVENTION

The present invention provides a system for ski selection which allows a user to readily select a pair of skis from pre-qualified manufactured skis having a combination of camber, length and stiffness to provide suitable characteristics to match the needs of the user, as well as providing a method for doing the same. With the engineered materials currently employed, it is possible to design a ski which, for the recreational skier for a given weight range, has an area sufficient to provide good glide characteristics during the glide action and sufficient flexibility to provide gripping action during the kick action. It has been found that, for inexperienced users, proper gripping action during the kick portion is critical, while providing proper glide action is less important. Quality control techniques can be applied to the manufacturing process to assure that the skis manufactured according to particular design criteria will provide suitable performance for users in the intended weight range without requiring individual testing, as is done with racing skis. The skis so manufactured are hereinafter referred to as pre-qualified skis.

The ski selection system and method of the present invention use the weight of the user as the index for choosing skis from pre-qualified groups of skis, but do not require the weight of the user be publicly disclosed or announced by the user. Not having to make public the weight of the user overcomes the problems discussed above associated with the reluctance of many users to disclose their weight. The system and method described hereafter are particularly helpful in retail establishments and ski rental establishments, where there is an opportunity to weigh the user in ski-ready attire.

The system needs access to the weight of the user for whom skis are being selected; however, this weight need not be directly disclosed or announced. The weight of the user is made accessible by means for accessing the unannounced weight of the user without disclosing the weight. The unannounced weight is a weight which is either known to the user and encoded via a system encoder before presentation to the system, or can be measured in such a way that the weight will not be visually or audibly perceptible by others, which is a preferred embodiment for on-site applications. The means for accessing the unannounced weight can be provided by employing a reference chart, which allows the user to encode his or her weight in such a manner as to be usable by the system. Alternatively, the weight of the user can be accessed through an input device of the system. A weighing station can be employed to access the weight, having a platform on which the user stands in combination with means for providing an output response which is proportional to the load applied to the platform but which does not present any numerical value for the weight. Alternatively, a user input interface such as a keyboard can be employed between the user and the system to allow the user to input his or her weight in an unannounced manner. This could be accomplished by a keyboard which has a screen viewable only by the user, so the weight typed in could be verified. Alternatively, the weight typed in could be printed for verification to a printer whose output was available only to the user, or for an even more secure input, the input could be verified only by reentry of the weight for confirmation, and not be printed or displayed.

The system is also provided with means for assigning the unannounced weight which has been accessed into one of a set of predefined weight ranges to provide a selected user weight range and for providing an encrypted user weight indicator corresponding to the selected user weight range. The means for assigning and providing a user weight indicator can be integral to the means for accessing the weight of the user. The predefined weight ranges are distributed such that they collectively provide a set of weight ranges which map onto the range of weights of the anticipated users of the system. The number of weight ranges employed is preferably between three and about eight, and the same number of user weight indicators are provided for association with pre-qualified manufactured skis. Preferably, a relatively small number of weight ranges are employed to reduce the inventory of skis needed. When using only a limited number of weight ranges, it may be advantageous to preferentially extend the lowest weight range and the highest weight range to include weights which would otherwise be placed into separate ranges.

When the system has a reference chart, the reference chart displays the predefined weight ranges and the corresponding user weight indicators, which allows the user to compare his or her weight to the predefined weight ranges and determine the weight range into which his or her weight falls. This selected weight range has a corresponding encrypted user weight indicator displayed on the reference chart and allows the user to determine the appropriate encrypted user weight indicator. Thus, the reference chart provides both the means for accessing the unannounced weight of the user and the means for assigning the weight into one of the predefined weight ranges to provide a selected user weight range and for providing an encrypted user weight indicator corresponding to the selected user weight range.

When the weight is accessed through an input device, the means for assigning the weight and for providing an encrypted user weight indicator are responsive to the accessed weight and act to provide the appropriate encrypted user weight indicator. When a weighing station is employed, the output response can be a mechanical response which moves an indicator with respect to a graphic display of the set of user weight indicators, in which case the weighing station typically has an encryption zone for each user weight indicator, the encryption zones being sized to correspond to the displacement of the indicator. Alternatively, the response can be an electronic signal which can be processed with appropriate means for conversion into a display of the appropriate user weight indicator. Similarly, if the user weight is accessed by a user input interface to an electronic system, the user input interface converts the weight to an electronic signal which can be processed to obtain the appropriate encrypted user weight indicator to be displayed.

Independent of the details of the above mentioned means, the system also includes a set of distinct ski indicia. The ski indicia are designed for placement on the skis from pre-qualified groups of manufactured skis, and each of the ski indicia match one of the user weight indicators. The ski indicia are assigned to the skis such that they mark skis that are designed for users having weights falling into the particular one of the predefined weight ranges which corresponds to the user weight indicator that matches that particular ski indicium. Preferably the ski indicia are provided on the skis themselves, such as by integral markings or labels applied thereto. In fact, in one preferred embodiment, a physical characteristic of the ski can serve as the distinct ski indicia. Alternatively, rather than being placed on the skis, the ski indicia could be associated with the skis by placement on a container in which the skis are displayed or on packaging for the skis. One preferred form of markings is to employ distinct colors for the user weight indicators and the matching ski indicia.

In a further preferred embodiment, which has particular utility for either sales or rental locations, the system includes a collection of groups of skis, each of the groups having skis that are designed for users having a weight which falls within a particular one of the predefined weight ranges. It is further preferred for the individual skis to be marked with the appropriate ski indicia. When the skis are being sold, the indicia could be removable labels or could be positioned so as to be covered by the ski binding, since the user may not wish to have the indicia as part of their skis. However, for rental skis, the ski indicia should be permanently affixed and positioned so as not to be covered by the ski binding. When the ski indicia are permanently affixed, they are preferably designed so as to not be visible under natural lighting.

When a physical characteristic of the ski is employed to provide the distinct ski indicia, such use of the physical characteristic should prevent the indicia from inadvertently disclosing information about the weight of the user. For example, skis in each group could be designed to have a distinct length, and the length of the ski could serve as the indicium. In this case, the encrypted user weight indicator would be an indication of the length and the distinct ski indicia would be the length of the skis, disguising the fact that the indicia are keyed to the weight of the user.

In the practicing the method of the present invention, a set of user weight ranges are defined. These weight ranges are defined such that they map onto the range of weights of anticipated skiers. Again, the lowest weight range and the highest weight range may be extended to limit the number of weight ranges. A set of encrypted user weight indicators is established, the user weight indicators corresponding to the defined user weight ranges.

A collection of skis is provided, the skis being pre-qualified manufactured skis sorted into groups which correspond to the user weight ranges selected. The pre-qualified skis in each group are designed and manufactured to provide suitable performance for users having any weight which falls within the corresponding selected weight range; however, it should be noted that skis in that particular group of skis may be designed for a design weight range which also includes weights outside the corresponding selected weight range, particularly when a large number of relatively narrow weight ranges are selected. Ski manufacturers can provide such pre-qualified manufactured skis by developing a particular geometry for each weight range using devices such as the taught in U.S. Pat. Nos. 3,922,908 and 4,164,875, discussed in the Background of the Invention, as tools to provide quality control.

A collection of distinct ski indicia is provided, the ski indicia each corresponding to one of the encrypted user weight indicators. The ski indicia are assigned to the skis so as to identify the skis belonging to each group. The distinct ski indicia are applied to the skis or packaging therefor so as to be consistent with the encrypted user weight indicators such that, by selecting skis marked with the ski indicia which match the user weight indicator for the weight range containing the weight of the user, the skis selected are suitable for the weight of the user. Preferably the indicia are applied to the skis themselves, so that each ski is appropriately marked.

To select the suitable user weight indicator to which the ski indicia are to be matched, the unannounced weight of the user is accessed without disclosing the weight to others. The unannounced weight is then assigned into the appropriate one of said predefined weight ranges, from which the corresponding encrypted weight indicator is identified. This can be done by the user viewing a reference chart or by other techniques discussed above in the discussion of the system.

A pair of skis is then selected, in which each of the skis is marked with the distinct ski indicia that match the identified encrypted weight indicator, to provide an appropriate pair of skis for the user based on the weight of the user.

As noted above, the number of weight ranges employed in both the system and the method of the present invention can vary, and the number of user weight indicators and different matching indicia varies accordingly. If the weight ranges are defined to be relatively coarse, it may be advantageous for users having a weight near the upper limit of one of the weight ranges and near the lower limit of another weight range to have the ski selection adjusted to correspond to the appropriate one of the two weight ranges in view of the relative strength, size, experience, etc. of the user. While including such considerations increases the ability of the system or method to provide appropriate skis, this advantage is achieved at the expense of greater complexity, and such considerations may be of benefit only for more sophisticated users.

BRIEF DESCRIPTION OF THE FIGURES

FIG. 5 also has an uncolored region indicating when none of the skis associated with the system are likely to be appropriate for the user. There is a notice on the weighing system that, if any of these regions are indicated, the user should seek assistance.

BEST MODE OF CARRYING THE INVENTION INTO PRACTICE

Figure 1:
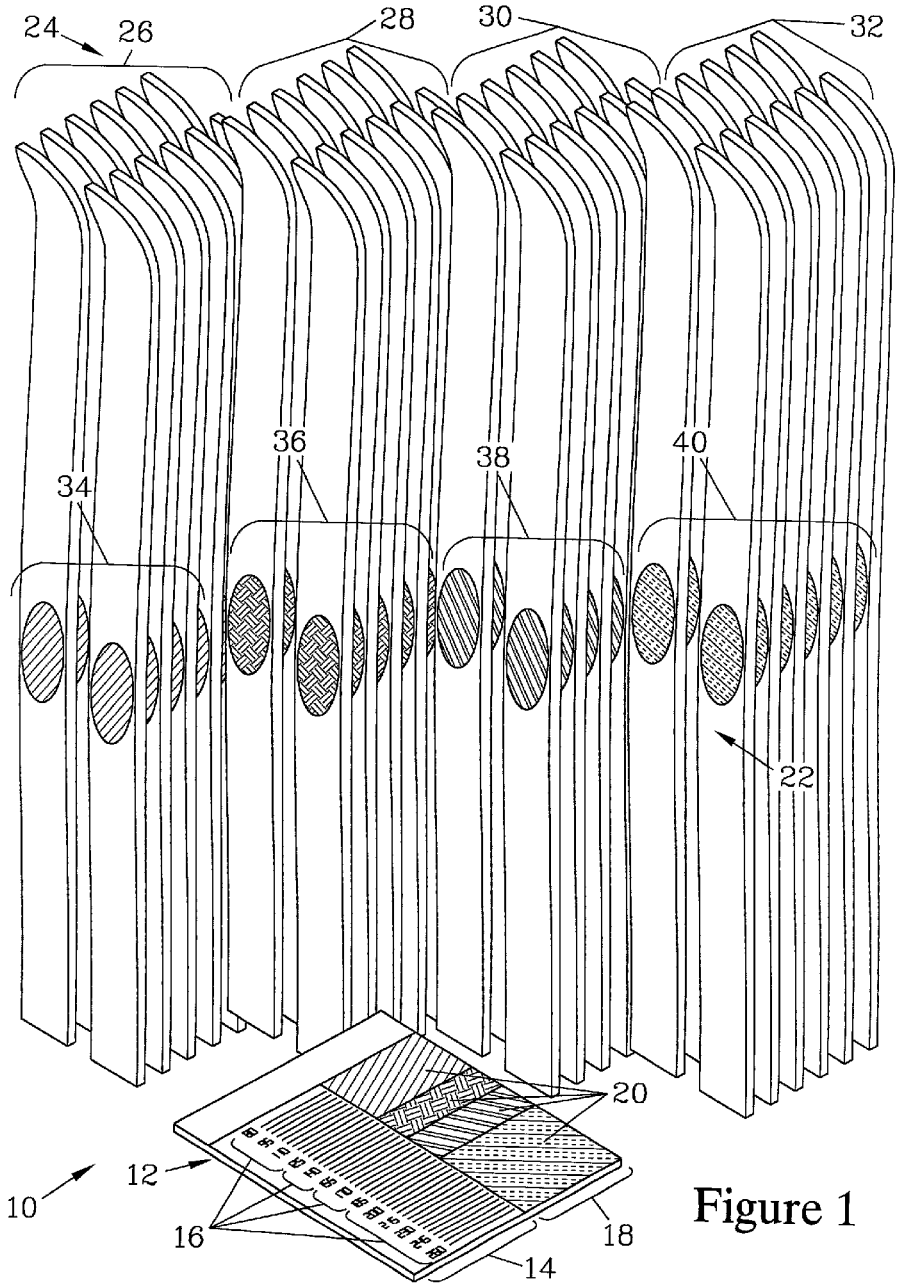
FIG. 1 is a schematic view showing one embodiment of a ski selection system of the present invention which has a collection of pre-qualified manufactured skis that are divided into four groups. Each of the groups contains skis engineered to suit the needs of skiers who fall within a particular weight range. Each of the skis is marked with a distinct ski indicium which is unique for each group. A chart is employed to serve as a combined means for accessing the unannounced weight of the user to provide an accessed user weight as well as means for assigning the accessed user weight into one of a set of predefined weight ranges to provide a selected user weight range and conversion of such to an encrypted weight indicator. The encrypted user weight indicator for each weight range and the distinct ski indicia are color-based in this embodiment.

FIG. 1 is a schematic view illustrating a ski selection system 10 which forms one embodiment of the present invention. The ski selection system 10 is designed to assist a user, who is a skier or a potential skier, to select a suitable pair of skis. The ski selection system 10 shown in FIG. 1 is a rudimentary embodiment of the present invention which employs a chart 12 which serves as a combined means for accessing the unannounced weight of a user to provide an accessed user weight without disclosing the unannounced weight, as well as means for assigning the accessed user weight into one of a set of predefined weight ranges and providing an encrypted user weight indicator.

The chart 12 has a predefined weight range display region 14 with a set of marked spatially arranged predefined user weight ranges 16. The user weight ranges 16 marked on the predefined weight range display region 14 allow the user to visually determine the appropriate weight range into which the weight of the user falls without disclosing the weight, so that the weight of the user remains unannounced.

The chart 12 also has a corresponding weight indicator region 18, positioned in a side-by-side relationship to the predefined weight range display region 14. The weight indicator region 18 displays encrypted user weight indicators 20 which are spatially arranged to correspond in a side-by-side relationship to the spatially arranged user weight ranges 16. The chart 12 allows the user to visually identify an appropriate encrypted user weight indicator 20 which corresponds to the user weight range 16 which includes the weight of the user. It is preferred that the encrypted user weight indicators 20 be very distinctive to allow the user to commit such to memory. Highly distinctive colors serve this function well; however, care should be taken to select colors that are distinctive even for color-blind users. As an alternative, an array of distinctive shapes can be employed for the encrypted user weight indicators 20, either alone or in combination with a color scheme.

The ski selection system 10 shown in FIG. 1 also includes a collection of distinct ski indicia 22 which are suitable for application to a collection of pre-qualified manufactured skis 24. In this embodiment, the ski indicia of the collection of distinct ski indicia 22 are applied directly to each of the skis in the collection of pre-qualified manufactured skis 24. The individual distinct ski indicia of the collection of distinctive ski indicia 22 are chosen to correspond to the various encrypted user weight indicators 20. The distinctive ski indicia of this embodiment are positioned on the skis such that they will be concealed under ski bindings (not shown) when the ski bindings are mounted to the skis of the collection of pre-qualified manufactured skis 24. While having the ski indicia so positioned is advantageous for skis which are sold, in rental situations it is preferred that the ski indicia not be concealed, since the selection process will be frequently repeated. For rental situations, the distinctive ski indicia are preferably applied to the skis so as to remain viewable when the ski bindings are applied, but are of such a character that the ski indicia are not distinguishable in natural light. For example, the ski indicia could be printed with an ink viewable only under ultraviolet light.

In the embodiment shown in FIG. 1, the collection of pre-qualified manufactured skis 24 forms a part of the ski selection system 10. The skis of the collection of pre-qualified manufactured skis 24 are constructed to meet four distinct sets of characteristics and, with these characteristics can be grouped accordingly into a first group of skis 26, a second group of skis 28, a third group of skis 30 and a fourth group of skis 32. Each of the individual ski groups (26, 28, 30, or 32) contains skis which are designed to provide suitable performance for users having a weight within a particular design weight range, and the skis in each particular ski group (26, 28, 30, or 32) are designed and qualified by the manufacturer to serve users within the corresponding design weight range. The design weight ranges for which the skis are designed correspond roughly to, but may extend somewhat beyond, the user weight ranges 16 indicated on the chart 12.

The collection of distinct ski indicia 22 in this embodiment includes ski indicia in a first group of indicia 34, a second group of indicia 36, a third group of indicia 38, and a fourth group of indicia 40. The indicia in each of the indicia groups (34, 36, 38 and 40) match one of the encrypted user weight indicators 20 displayed on the chart 12. The individual ski indicia in each of the indicia groups (34, 36, 38 and 40) are placed on the skis in the particular group of pre-qualified manufactured skis (26, 28, 30, or 32) having a design weight range corresponding to the one of the predefined user weight ranges 16 which corresponds to the one of the encrypted user weight indicators 20 that matches the indicia in that particular group of ski indicia (34, 36, 38 or 40). Thus, each of the indicia groups (34, 36, 38 and 40) is distinct to a respective one of the ski groups (26, 28, 30, or 32), and the individual indicia each serve to identify the ski group (26, 28, 30, or 32) to which the ski marked with that particular indicium belongs.

Figure 2:
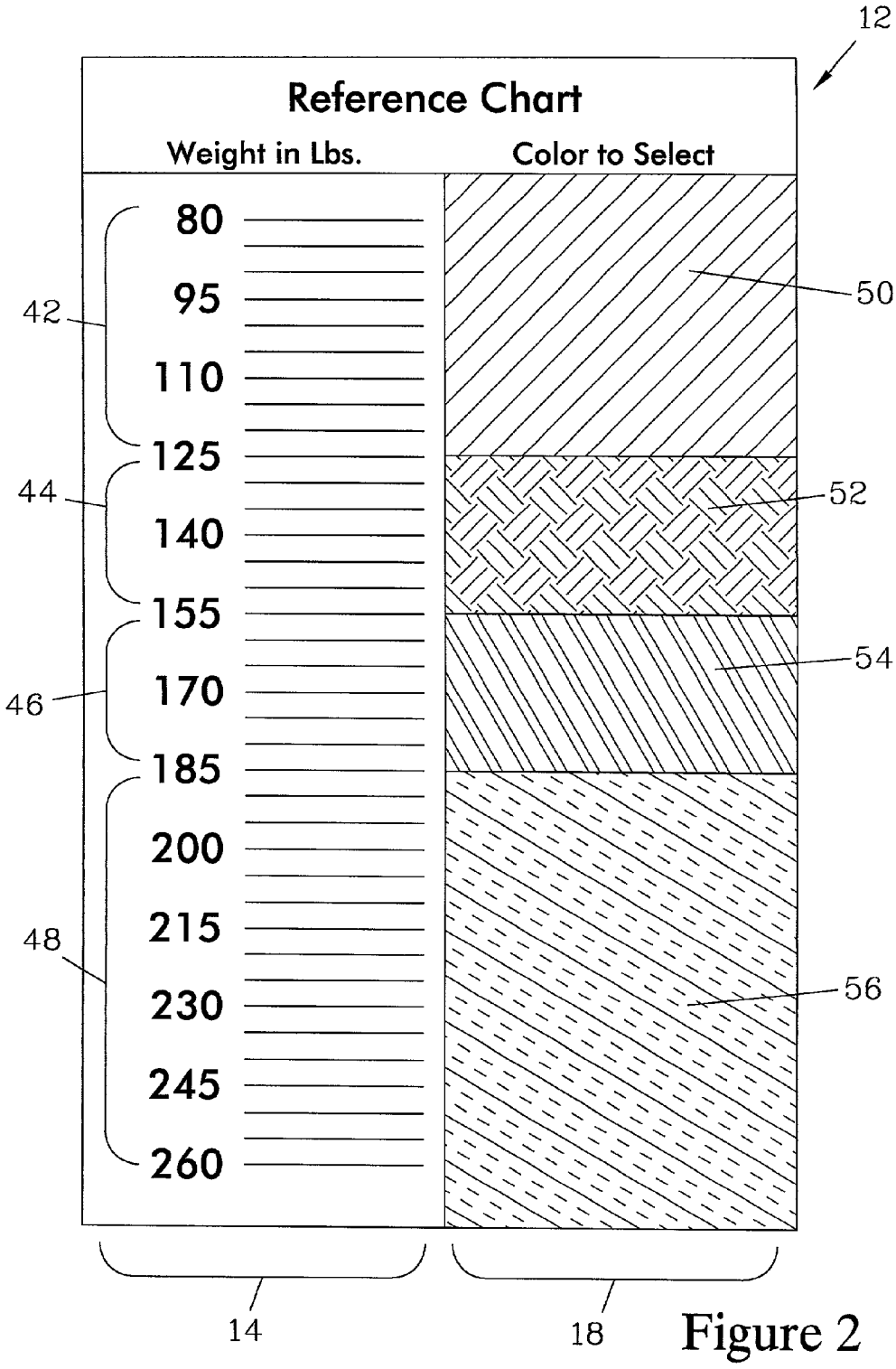
FIG. 2 is a detailed view of the chart of FIG. 1, showing one example of the weight ranges and the corresponding user weight indicators.

The predefined user weight ranges 16, which are collectively illustrated on the chart 12 shown in FIG. 1, are respectively labeled 42, 44, 46, and 48 in FIG. 2, which illustrates more specific details of the chart 12. The chart 12 shows exemplary values for the user weight ranges (42, 44, 46, and 48), which are displayed in a side-by-side relationship with associated encrypted user weight indicators 50, 52, 54, and 56. It should be noted that the user weight ranges (42, 44, 46, and 48) shown on the chart 12 are somewhat more limited than the design weight ranges set by the manufacturer of the pre-qualified manufactured skis. The encrypted user weight indicators (50, 52, 54, and 56) match the appropriate respective ski indicia in the indicia groups (34, 36, 38 and 40) and allow a user to visually convert his/her weight to an appropriate encrypted weight indicator (50, 52, 54, and 56). The encrypted user weight indicators (50, 52, 54, and 56) on the chart 12 could be provided as pads having stacked sheets, each sheet having the encrypted user weight indicator (50, 52, 54, or 56) printed thereon for removal by the user to use as a reference to select a pair of skis from the appropriate group of skis (26, 28, 30, or 32) by matching the user weight indicator (50, 52, 54, or 56) on the sheet with its corresponding group of indicia (34, 36, 38 or 40).

The fact that not all people of equal weight will operate the skis with the same forces can be reconciled in one of two ways. The first, and most simplistic solution, is to simply select skis from the group having a design weight range corresponding to the predefined user weight range into which the weight of the user falls. The second solution, when the weight of the user approaches the boundary between two of the predefined user weight ranges, is to provide a notice that an adjustment might be appropriate and provide instructions for selecting between the two ranges based on the answers to questions such as athletic ability or how active the user is, or by consulting an assistant.

The ski selection system 10 shown in FIGS. 1 and 2 employs the first solution. With this solution, all weights which fall within a particular one of the user weight ranges (42, 44, 46, or 48) are directly correlated with the appropriate one of the encrypted user weight indicators (50, 52, 54, or 56). As can be seen, the user weight ranges (42, 44, 46, or 48) and the encrypted user weight indicators (50, 52, 54, or 56) are so arranged that a lateral transfer from the position corresponding to the weight of the user on the predefined weight display region 14 to the weight indicator region 18 falls within a particular one of the encrypted user weight indicators (50, 52, 54, or 56). This encrypted user weight indicator (50, 52, 54, or 56) can then be used to select a pair of skis bearing ski indicia from the indicia group (34, 36, 38 or 40) which match that particular encrypted user weight indicator (50, 52, 54, or 56).

Table I provides the numerical values for the limits of these user weight ranges (42, 44, 46, and 48) and also shows an example of corresponding colors which have been used for the encrypted user weight indicators (50, 52, 54, and 56) associated with each user weight range and for matching ski indicia in the indicia groups (34, 36, 38 and 40).

TABLE I

| Range No. | Weight greater than: | Weight less than: | Indicator |
|---|---|---|---|
| 42 | 80 lbs. (36 kg) | 125 lbs. (57 kg) | Green |
| 44 | 125 lbs. (57 kg) | 155 lbs. (70 kg) | Yellow |
| 46 | 155 lbs. (70 kg) | 185 lbs. (84 kg) | Red |
| 48 | 185 lbs. (84 kg) | 260 lbs. (118 kg) | Blue |

In the ski selection system 10 illustrated, the distinct ski indicia in the indicia groups (34, 36, 38 and 40) are colored areas or labels which respectively match the user weight indicators (50, 52, 54, and 56). The ski indicia in the indicia group 34 are green to match the color of the encrypted user weight indicator 50 on the chart 12. The ski indicia from the indicia group 34 are applied to skis from the first group of pre-qualified manufactured skis 26, which are all designed to provide adequate performance when employed by users having a weight of at least about 80 lbs. (36 kg) and up to 125 lbs. (57 kg). That is, the length, the width, the camber and the stiffness of the skis in the first group of skis 26 are selected such that, when a user having a weight within the first weight range 42 is supported on a pair of skis from the first group of skis 26, the gripping area (not shown) of each of the skis is raised off of the snow during the glide portion of the skiing action, while the skis can be deflected enough under the action of the user during the kick portion to bring the gripping portion into contact with the snow surface.

In a similar manner, the ski indicia from the indicia group 36 are yellow to match the color of the encrypted user weight indicator 52, and are applied to skis in the second group of skis 28, which are all designed to provide adequate performance when employed by users having a weight between about 120 lbs. (54 kg) and 155 lbs. (70 kg). Similarly, the ski indicia from the indicia group 38 and the encrypted user weight indicator 54 are colored red and the ski indicia from the indicia group 40 and the encrypted user weight indicator 56 are colored blue, and the ski indicia from these indicia groups (38, 40) are applied respectively to skis from the third group of skis 30 and the fourth group of skis 32, the skis in these groups (30, 32) being designed for users having weights falling within the remaining weight ranges specified in Table I.

As can be seen from Table I, the weight ranges 42 and 48, which are respectively the lightest weight range and the heaviest weight range, include a greater range of weights than the weight ranges 44 and 46, which are for intermediate weights. The weight ranges 42 and 48 have been extended to include weights which might otherwise be in separate weight ranges, in part to limit the total number of weight ranges to simplify the selection process. However, there are some physical bases for the extension of these ranges. The extension of the upper range requires the user to transfer less of the user's weight on a percentage basis in the kick mode. Similarly, for the lightest range, the very light adult is likely to be more energetic and thus will not need as much total weight to place the ski in kick mode.

While the ski selection system 10 provides a system with great simplicity and is well suited for applications where the user is at a remote site from the location of the skis, such as when ordering skis from a catalog or via an Internet site, the system provides only a limited degree of security against disclosure of the weight of the user. The encrypted user weight indicators may become so familiar to the public in time that, unless the encrypted user weight indicators and the associated distinct ski indicia are frequently changed, at least the predefined weight ranges will become known. While such may not be as objectionable to the users as the disclosure of the specific weight of the user, if the user weight range into which a user falls is substantially different from the weight which the user feels comfortable in disclosing, disclosing the weight range will be objectionable. Furthermore, if Internet communications are employed and a graphic or color is employed as the distinct ski indicia, some method of converting the encrypted user weight indicator may be needed to transfer the identity of the user weight indicator selected by the user over the Internet for matching to the ski indicia to select a pair of skis for the user.

In the case of using the system of the present invention on the Internet, it is more convenient to have a user input interface which allows the user to directly input the unannounced weight of the user. In the Internet situation, if the user accesses the Internet via a computer in the home of the user, the keyboard of the computer can serve as the user input interface and verification of the weight can be provided by having the weight, after entry, displayed on a screen, which should not be objectionable to the user. If such display is objectionable, the keyboard could still be used for inputting the weight of the user without displaying the weight, in which case verification of the proper entry of the weight could be obtained by having the weight entered a second time to confirm its proper entry. This latter scheme for entry of the weight of the user would be suitable for use in situations where the user accesses the Internet at a public location, such as a public library.

The use of a keyboard for entry of the weight of the user in combination with a computer or dedicated microprocessor can also have advantages for an on-site operation such as a ski rental shop or a store. In such situations, the microprocessor can be programmed to serve as means for assigning the accessed user weight to one of a set of predefined user weight ranges to provide a selected user weight range and for providing an encrypted user weight indicator which is distinct to the selected user weight range. When a computer or microprocessor is employed, the system can be provided with a printer which prints the appropriate encrypted user weight indicator for the user to either present to a rental agent or for use as the user selects a pair of skis from a rack.

Figure 3:
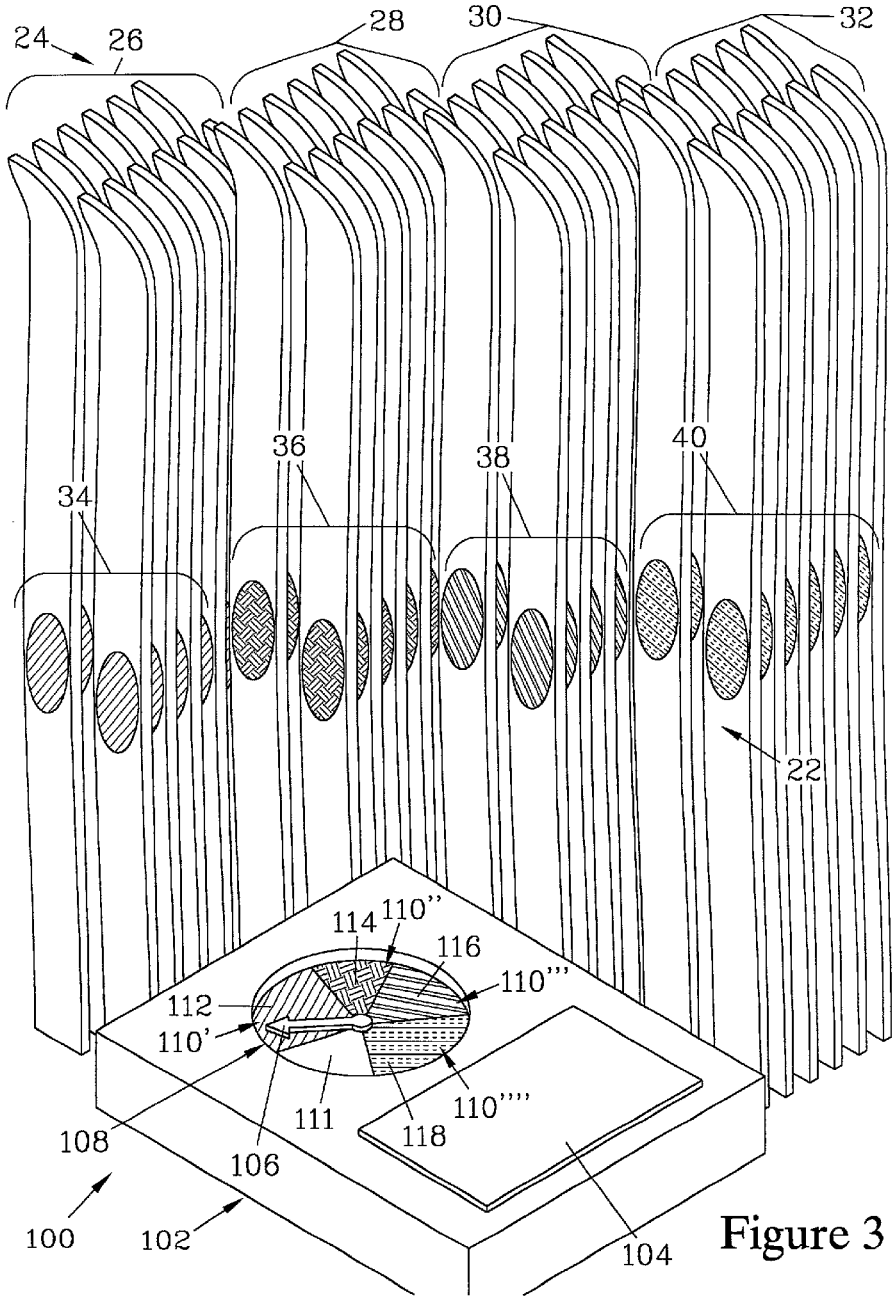
FIG. 3 is a schematic view of another ski selection system of the present invention, which employs the same collection of skis and distinctive ski indicia as shown in FIG. 1. The system of this embodiment differs, in part, in that the system employs a weighing station to access the weight of the user. The weighing station converts the unannounced weight of the user into a reading on a face of the weighing station which provides an encrypted user weight indicator that corresponds to the appropriate one of the distinct ski indicia for the user.

The weight of a user can be further secured from inadvertent disclosure by employing a ski selection system which does not require the user to provide the weight value. FIG. 3 illustrates a ski selection system 100 which measures the weight of the user without disclosing the same. The ski selection system 100 employs the collection of ski indicia 22 and the collection of skis 24, which for this embodiment are the same as illustrated in FIG. 1 and discussed above. The ski selection system 100 differs from the ski selection system 10 shown in FIG. 1, in part, in that a weighing station 102 is employed as a combined means for accessing the unannounced weight of the user without disclosing the weight and means for assigning the unannounced weight into one of a set of predefined weight ranges and for providing an encrypted user weight indicator corresponding to that particular user weight range.

The weighing station 102, which for this embodiment is a modified scale, has a weighing platform 104 and a rotatable pointer 106, as is typical with many scales. The weighing station 102 differs from conventional scales in that it is not provided with a standard numerical scale face, but rather employs a face 108 which is partitioned into four encryption zones 110 and one out-of-range zone 111. Each of the encryption zones 110 corresponds to a predefined user weight range, such as the user weight ranges (42, 44, 46, and 48) shown in Table I. The encryption zones 110 are marked with encrypted user weight indicators 112, 114, 116, and 118, which in this embodiment respectively match the distinct ski indicia of the indicia groups (34, 36, 38 and 40) which again are the same as employed in the embodiment shown in FIGS. 1 and 2. The out-of-range zone 111 is preferably marked with a message instructing the user to ask for assistance.

The weighing station 102 can employ a conventional internal mechanism (not shown) for moving the pointer 106 in response to the load applied to the weighing platform 104. Such mechanisms for achieving a proportional output in response to an applied load are well known in the art, and include spring mechanisms, pressure transducers in combination with circuitry and some form of display, and similar devices. When the user stands on the weighing platform 104, the rotational displacement of the pointer 106 is proportional to the weight of the user, and the weighing platform 104, the internal mechanism, and the pointer 106 in combination serve to access the weight of the user. Since the face 108 does not display any numerical values, the weight of the user is not disclosed, and the public cannot readily associate a particular one of the encrypted user weight indicators (112, 114, 116, or 118) with a particular weight range.

Since the displacement of the pointer 106 is proportional to the weight of the user, the encryption zones 110 can be sized and positioned with respect to the displacement of the pointer 106 such that the pointer 106 is positioned within a particular zone 110 when a weight within a corresponding one of the user weight ranges is applied to the weighing platform 104. Each particular encryption zone 110 is marked with the encrypted user weight indicator (112, 114, 116, or 118) appropriate for that weight range, allowing the weighing station 102 to assign the weight of the user into an appropriate weight range and provide an encrypted weight indicator.

In this embodiment, the encryption zones 110 are marked on the face 108 so as to correspond to the user weight ranges (42, 44, 46, and 48) set forth in Table I. For example, when a user having a weight of at least about 80 lbs. (36 kg) and up to 125 lbs. (57 kg) stands on the weighing platform 104, the pointer 106 is displaced so as to be positioned within a particular region of the face 108, and this region is defined as the encryption zone 110'. The encryption zone 110' is marked with the user weight indicator 112, and in this example the user weight indicator 112 is the green color of the encryption zone 110'.

Similarly, when a user weighing more than 125 lbs. (57 kg) and up to 155 lbs. (70 kg) stands on the weighing platform 104, the pointer 106 is displaced to a position which falls within another region of the face 108, and this region is defined as the encryption zone 110". The encryption zone 110" is marked with the user weight indicator 114 which is the yellow color of the encryption zone 110". The encryption zone 110''' and the encryption zone 110'''' are similarly defined on the scale face 108, these encryption zones (110''' and 110'''') being positioned such that the pointer 106 becomes positioned over the encryption zone 110''' when the weight of the user is greater than 155 lbs. (70 kg) and up to 185 lbs. (84 kg) and becomes positioned over the encryption zone 110'''' when the weight of the user is above 185 lbs. (84 kg) and up to about 215 lbs. (98 kg). The encryption zone 110''' is marked with the user weight indicator 116, which is red, and the encryption zone 110'''' is marked with the user weight indicator 118, which is blue.

When the weight of the user is outside of the user weight ranges discussed above, the pointer 106 is positioned over a region of the face 108 which lies outside of the encryption zones 110. This region is defined as the out-of-range zone 111, and when the pointer 106 is positioned over this range, it indicates that the user may not be able to obtain adequate performance from any of the skis in the collection of skis 24. The out-of-range zone 111 is marked with a message to ask for assistance to allow store or rental agency staff to assist the user when the pointer 106 is in the out-of-range zone 111. This provides the same accommodation to the user as being off the chart provides with the system 10 shown in FIGS. 1 and 2. It should be noted that in this embodiment, the cutoff for the heaviest weight range is selected to be 215 lbs. (98 kg) rather than 260 lbs. (118 kg) as was employed in the embodiment shown in FIGS. 1 and 2.

Figure 4:
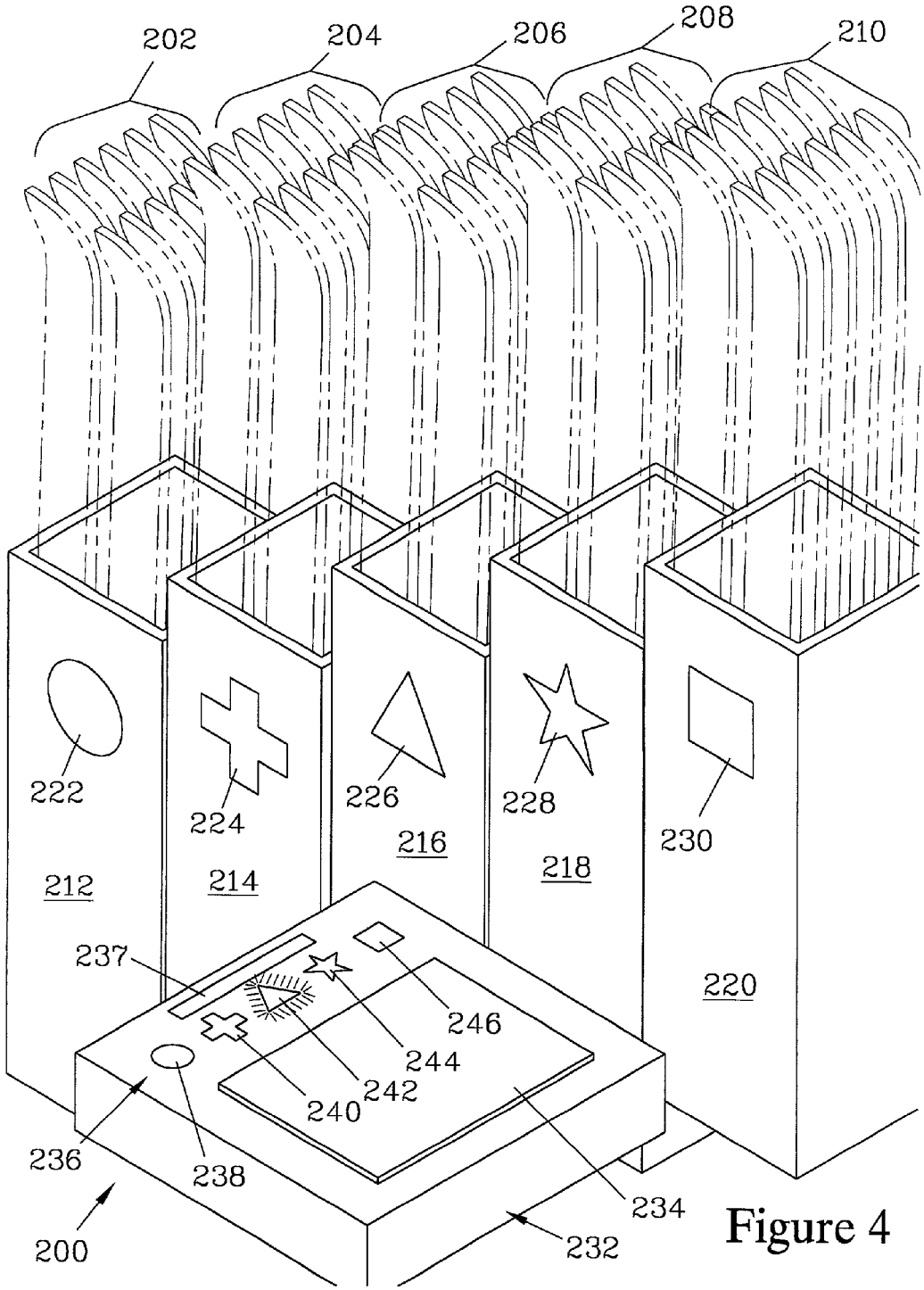
FIG. 4 is a schematic view of another embodiment of a ski selection system of the present invention, which employs a collection of pre-qualified manufactured skis which are manufactured to five standards based on the weight of the user. This embodiment has bins in which the skis are placed, each of the bins being marked with one of five distinct ski indicia. A weighing station is provided to convert the weight of the user to an encrypted user weight indicator which matches an appropriate one of the distinct ski indicia.

FIG. 4 is a schematic view that illustrates another embodiment of the present invention, a system 200 for sorting skis into groups and allowing users to select a pair of skis from the group of skis which are appropriate for the weight of the user. As with the earlier systems, the system 200 addresses the issue of different users of similar weight operating the skis with different forces by employing the simpler solution, where a user weight indicator is directly correlated with the weight of the user. The system 200 employs five different predefined weight ranges, and is used in combination with a first group of skis 202, a second group of skis 204, a third group of skis 206, a fourth group of skis 208, and a fifth group of skis 210, all of which are shown in phantom in FIG. 4. The individual skis within each of the ski groups (202, 204, 206, 208, or 210) are essentially uniform and are designed, manufactured, and pre-qualified to be suitable for use by skiers having a weight within one of the five predefined weight ranges.

The system 200 employs five bins 212, 214, 216, 218, and 220 for holding the groups of pre-qualified manufactured skis (202, 204, 206, 208, and 210). The bins (212, 214, 216, 218, and 220) are respectively marked with distinct ski indicia 222, 224, 226, 228, and 230. In the embodiment shown, the distinct ski indicia (222, 224, 226, 228, and 230) are different shapes which are displayed on the bins (212, 214, 216, 218, and 220). The distinct ski indicia (222, 224, 226, 228, and 230) respectively serve to identify the ski group (202, 204, 206, 208, or 210) to which the skis contained in each of the bins (212, 214, 216, 218, and 220) belong, without requiring the skis themselves to be marked.

The system 200 also includes a weighing station 232 which is similar in operation to a conventional electronic scale which produces a signal that is proportional to the weight of the user. The weighing station 232 has a platform 234 on which the user stands, and produces an output signal (not shown) in response to loads applied to the platform 234. Such an output signal can be provided by various means known in the art, such as by a pressure transducer, combined spring and displacement sensor, etc. The platform 234 and the means for producing an output signal provide, in combination, means for accessing the weight of the user.

The weighing station 200 also processes the output signal to determine which of the five predefined weight ranges the load applied to the platform 234 falls within, and illuminates one of a set of user weight indicators 236 in response. If the output signal does not correspond to any of the predefined weight ranges, none of the user weight indicators 236 are illuminated and a notice 237 is lighted instructing the user to ask for assistance. The user weight indicators 236 are provided by five separate indicator lights 238, 240, 242, 244, and 246 which have distinct shapes that respectively match the shapes of the ski indicia (222, 224, 226, 228, and 230). It should be appreciated that these distinct shapes could alternatively be selectively displayed on a single display such as an LED or LCD display.

The means employed by the weighing station 232 to convert the output signal into an appropriate one of the user weight indicators 236 can operate in various ways. The weighing station 232 could employ dedicated circuitry or, alternatively, could employ a microprocessor in combination with one or more instruction sets to process the output signal. In the latter case, the microprocessor can be instructed to compare the output signal to stored values corresponding to the output values for loads delineating the predefined weight ranges in order to determine the weight range into which the weight of the user belongs, and then can be instructed to consult a table to determine the appropriate one of the user weight indicators 236 to be illuminated to correspond to that particular weight range. The appropriate indicator light (238, 240, 242, 244, or 246) can then be activated or, in the alternative, the notice 237 can be illuminated.

The user then selects a pair of skis from the group of skis (202, 204, 206, 208, or 210) contained in whichever one of the bins (212, 214, 216, 218, or 220) is marked with the one of the ski indicia (222, 224, 226, 228, or 230) that matches the illuminated indicator light (238, 240, 242, 244, or 246). For example, if the weight of the user falls into the intended weight range of the skis in the third group of skis 206, the weighing station 232 is calibrated such that the indicator light 242 is illuminated when the user stands on the platform 234. As shown in FIG. 4, the indicator light 242 is triangular in shape. The user then selects a pair of skis from the bin 216 which is marked with the ski indicium 226, which has a triangular shape matching the shape of the indicator light 242. The bin 216 contains skis from the third group of pre-qualified manufactured skis 206, and thus the pair of skis which is selected are appropriate for the weight of the user. After the user has selected the skis, the skis bear no indication that they belong to the third ski group 206, and thus do not disclose any information about the weight of the user.

Figure 5:
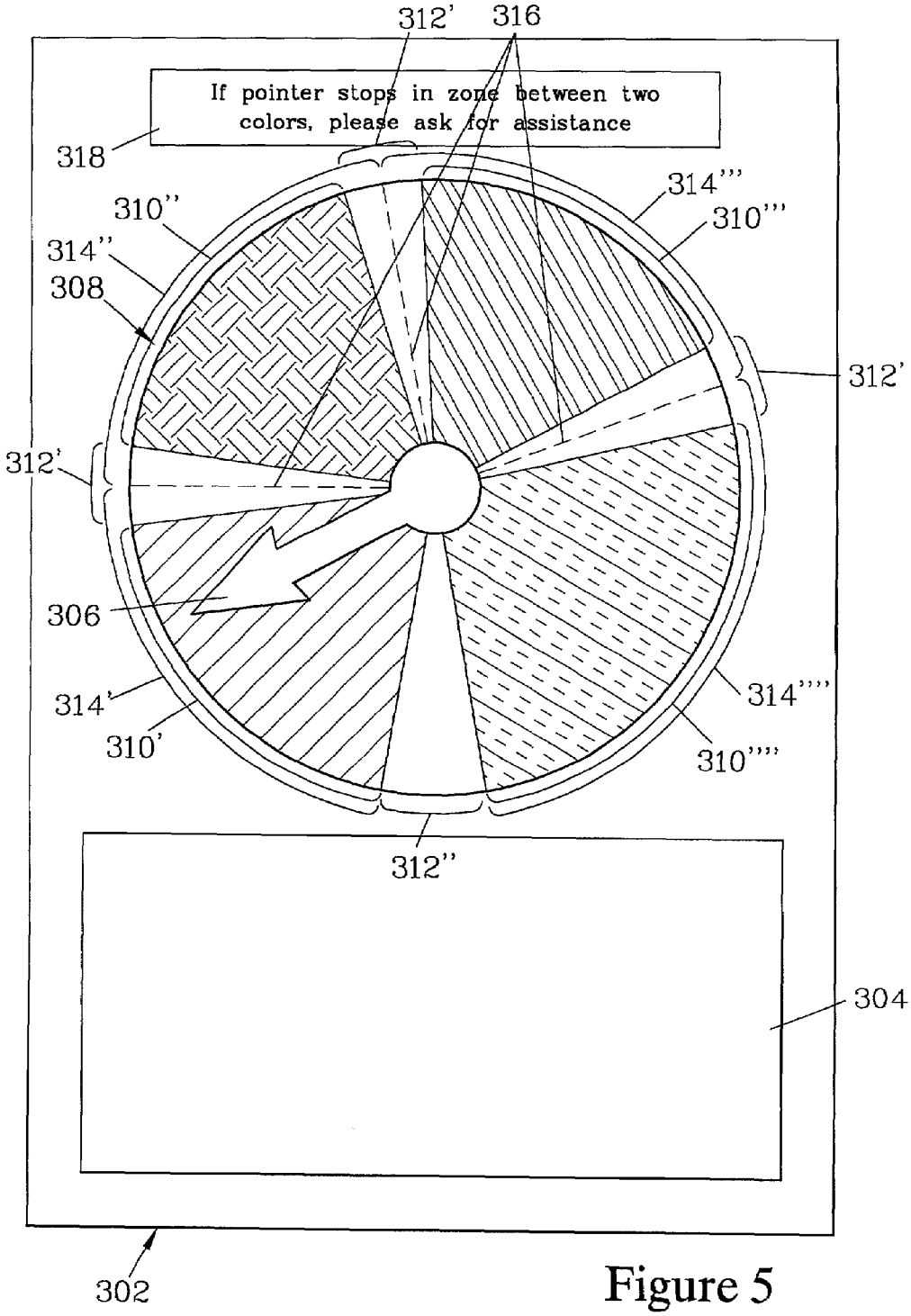
FIG. 5 is a view illustrating a dial for a modified weighing station similar to the weighing station shown in FIG. 3, but which has overlapping regions between the encrypted user weight indicators to indicate that assistance should be sought to help assess additional factors which should be considered in selecting a pair of skis.

The systems described above allow users to select appropriate skis based solely on the weight of the user and give no consideration to the proximity of the weight of the user to a boundary between two predefined user weight ranges. Thus, even users who have a weight near the boundary between two of the predefined user weight ranges do not have other factors, such as whether the user is a particularly athletic or leisurely skier, taken into consideration when selecting a pair of skis. The weighing station 302 illustrated in FIG. 5 can be employed in a ski selection system (not shown) to offer some accommodation of factors other than weight to personalize the selection of skis for such users.

The weighing station 302 is again a modified scale which has a weighing platform 304 and a rotatable pointer 306. The weighing station 302 does not have a conventional numerical face, but rather employs a face 308 which is partitioned into four encryption zones 310 which are separated by encryption-free zones 312. Each of the encryption zones 310 correlates to one of four predefined user weight ranges 314, such as the user weight ranges (42, 44, 46, and 48) shown in Table I.

However, in this embodiment the encryption zones 310 are less extensive than the underlying user weight ranges 314, giving rise to encryption free zones 312' in the vicinity of three weight zone boundaries 316 between adjacent user weight ranges 314. The face also has an encryption free zone 312" which corresponds to the out-of-range zone 111 of the weighing station 102 shown in FIG. 3.

Again, if the user has a weight such that the pointer 306 moves to a position in any of the encryption free zones 312, the user can be instructed to ask for assistance in all cases, such as by use of a label 318 on the weighing station 302. Alternatively, if the pointer 306 is over an encryption free zone 312' that straddles one of the weight zone boundaries 316, an instruction sheet can be provided to assist the user or the user could be queried by a computer of the ski selection system to make a more refined selection of skis (not shown) from one of two groups which are respectively designed to be suitable for the two user weight zones which share that particular weight zone boundary 316.

If the skier is near the upper limit of a particular weight range, but is athletic and a very aggressive skier, then they may wish to select skis intended for users having weights in the next heavier weight range. Alternatively, if a leisurely skier is near the bottom of a weight range, they may find that a ski intended for users in the next lower weight range might well be the best ski for their use.

Figure 6:
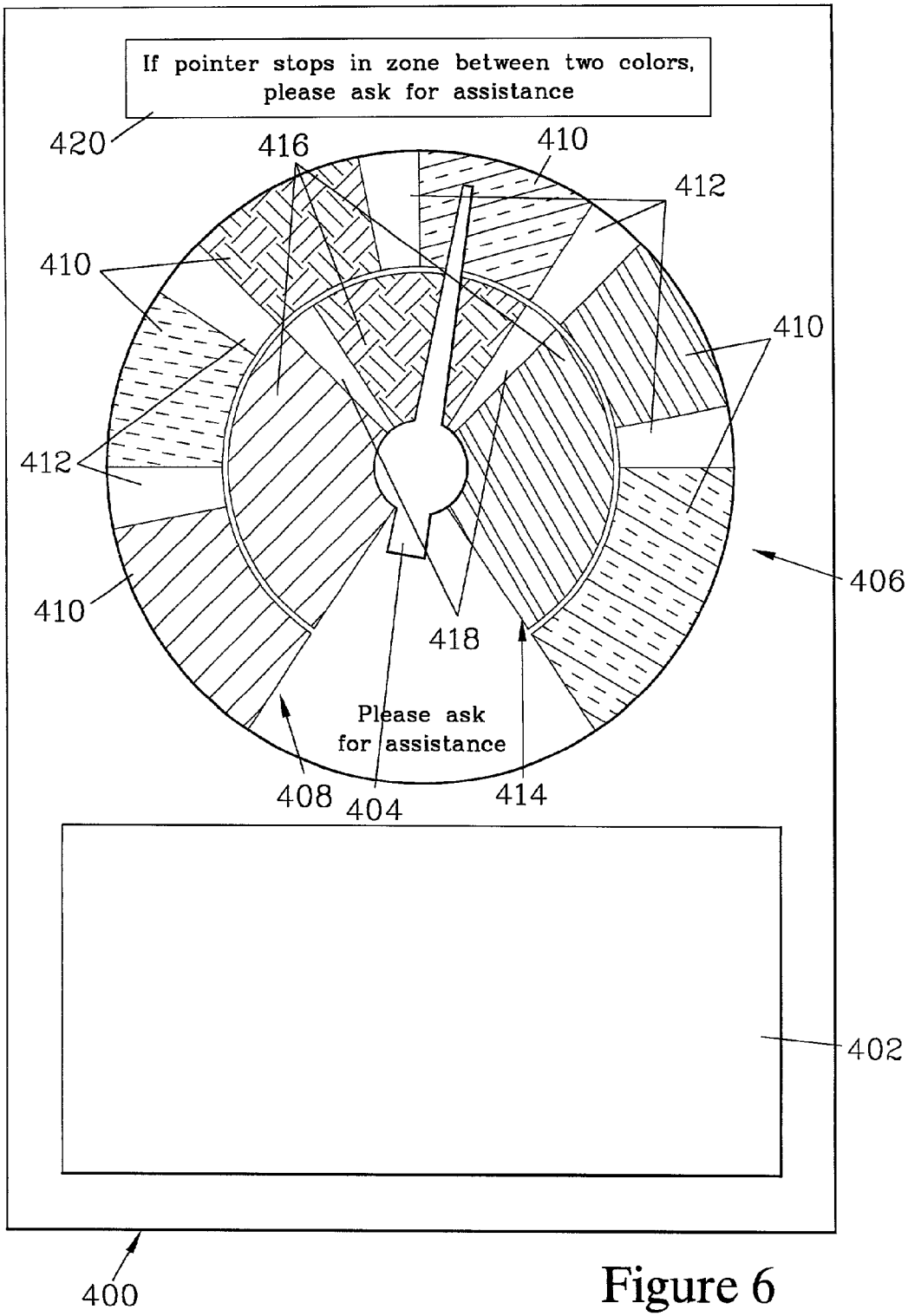
FIG. 6 is a view showing a weighing station which is designed assist a user in selecting skis from two lines of pre-qualified manufactured skis. Both of the lines are designed for use by a portion of the adult population and exclude very light users, for whom children's skis would be appropriate, and very heavy users, for whom it is not cost effective to include skis in the line. One line of skis contains skis suitable for users having a weight within one of six overlapping weight ranges, and the other contains skis suitable for users having a weight within one of three overlapping ranges. The weighing station provides an instructional message noting when assistance by a shop salesperson should be sought.

While all the ski selection systems discussed above have been designed to help users select a pair of skis from a single series of skis, it is possible to use the system of the present invention to select skis from two or more series of skis. FIG. 6 illustrates a weighing station 400 which could be employed to select skis from two series of pre-qualified manufactured skis (not shown). Each series includes a number of groups of skis to provide skis suitable for users falling within the anticipated distribution of user weights. In the example illustrated, a first series of skis has six different groups of skis, such as might be used for more experienced skiers who demand a higher standard of performance, each of the groups being designed for users in a corresponding user weight range. A second series of skis has only three different groups, such as might be used for inexperienced skiers for whom obtaining proper gripping action during the kick portion of the skiing action is the primary consideration. Again, each of the groups in the second series of skis is designed for users having a weight within a corresponding predefined user weight range.

The weighing station 400 has a weighing platform 402, a rotating pointer 404, and a face 406. The face 406 of the weighing station 400 has an outer portion 408, which is marked with six outer encryption zones 410 that are separated by outer encryption-free zones 412. The outer encryption zones 410 correspond to underlying user weight ranges in the manner described above with respect the weighing station 302. The outer encryption zones 410 are marked with colors which serve as encrypted user weight indicators for each of the user weight ranges for the skis in the first series. The method of selecting skis for a user who is using the outer portion 408 is the same as described above for the weighing station 302.

The face 406 also has an inner portion 414, which is marked with three inner encryption zones 416 that are separated by inner encryption-free zones 418. The inner encryption zones 416 again correspond to the underlying user weight ranges in the manner described above with respect to the weighing station 302, and the inner encryption zones 416 are marked with colors which serve as encrypted user weight indicators for each of the user weight ranges for the skis in the second series. Again, the method for selecting skis for a user who is using the inner portion 414 is the same as described above for the weighing station 302.

Figure 7:
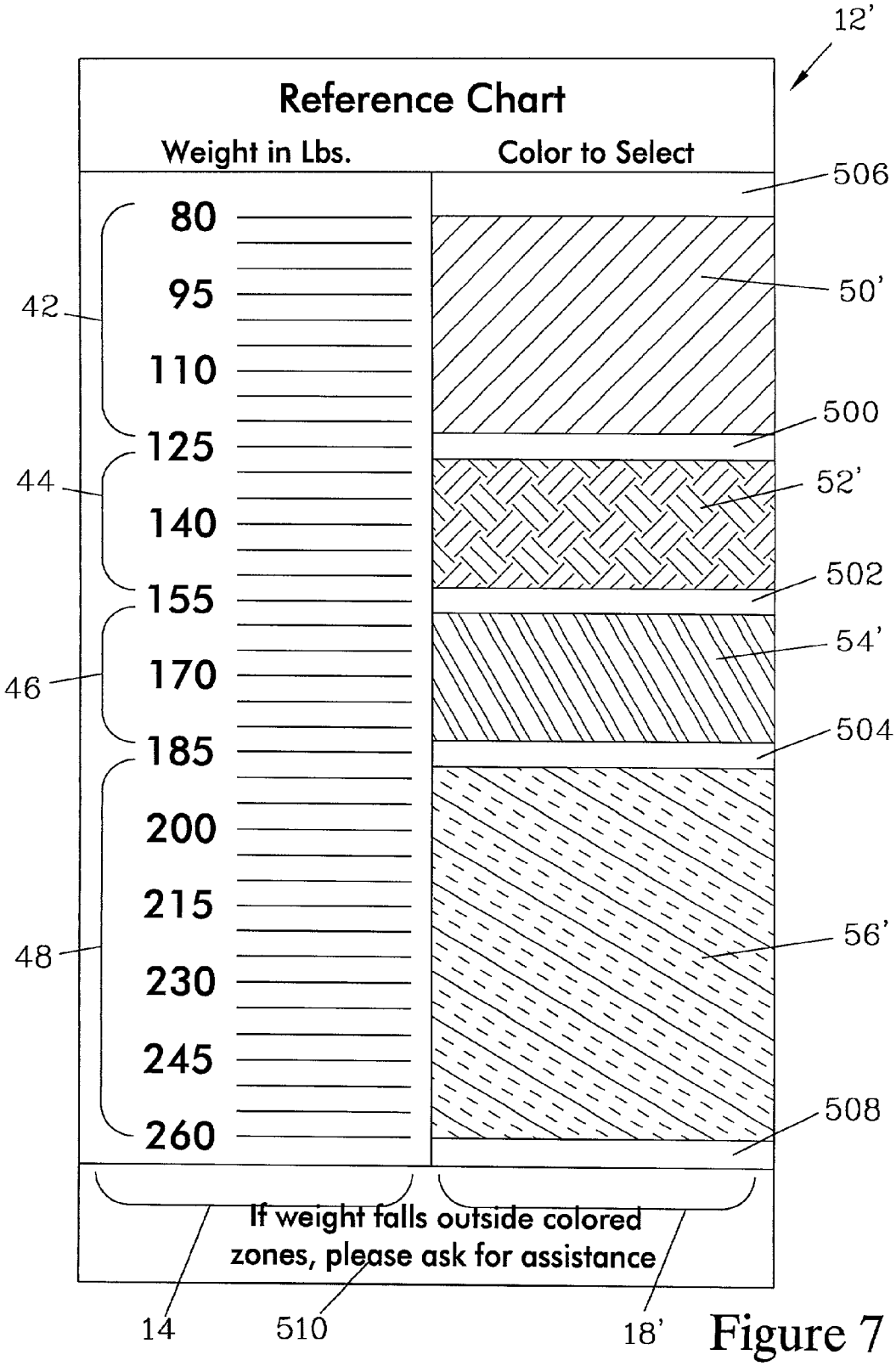
FIG. 7 is a view illustrating a reference chart that can be used with the ski selection system.

FIG. 7 illustrates an alternate reference chart 12' which can be used with the ski selection system 10 shown in FIG. 1 in place of the reference chart 12. The reference chart 12' again shows the predefined user weight ranges, which are respectively labeled 42, 44, 46, and 48 and remain unchanged, as well as associated encrypted user weight indicators 50', 52', 54', and 56' that are positioned in a side-by-side relationship to the predefined user weight ranges (42, 44, 46, and 48). However, in the reference chart 12' the zones occupied by the encrypted user weight indicators (50', 52', 54', and 56') do not meet, but rather are separated by encryption-free zones 500, 502, and 504, which for the embodiment illustrated are colorless regions in the weight indicator region 18'. The weight indicator region 18' also has an encryption-free zone 506, which terminates the encryption zone 50', and an encryption-free zone 508, which terminates the encryption zone 56'.

The chart has a legend 510 which instructs the user to seek assistance if transferring the weight of the user across from the predefined weight range display region 14 to the weight indicator region 18' directs the user to one of the encryption-free zones (500, 502, 504, 506, or 508). This assistance could be given by a service attendant or, when the user is directed to one of the encryption-free zones 500, 502, or 504, could be a set of instructions given to the user to help the user to make a selection between the two bordering encrypted user weight indicators (50', 52', 54', and 56'). Alternatively, such assistance could be provided by a questionnaire designed such that the answers would direct the user to an appropriate choice. When the user is directed to one of the encryption-free zones 506 or 508, the instructions or questionnaire could guide the user in determining whether to select the encrypted user weight indicator (50' or 56') which is bounded by that particular encryption-free zone (506 or 508), or whether the user should select skis which are not part of the collection of skis 24.

While the discussion above and the examples given have treated the encrypted user weight indicators and the collection of distinct ski indica as either a shared color, symbol, graphic, or a combination thereof, it is also possible to use a distinctive characteristic of the ski itself as indicia for identifying the group to which the ski belongs, and a physical expression of the same as the user weight indicator. For example, four groups of pre-qualified manufactured skis designed to be suitable for skiers in the same weight ranges as set forth in Table I above can be designed such that, as the values for the design weight range increase, the ski length also increases. Thus, each group of skis would have a unique length, as set forth below in Table II, and this length could serve as the indicia. The user weight indicator in such a case would be a numerical value for the ski length, and could be used in the manner discussed above with respect to the various embodiments. This scheme would have particular appeal in the rental business, since skis are easily sorted and stored by length and could be reissued according the encrypted user weight indicator which could be supplied as discussed above.

TABLE II

| Weight greater than: | Weight less than: | Ski Length |
|---|---|---|
| 80 lbs. (36 kg) | 125 lbs. (57 kg) | 170 cm |
| 125 lbs. (57 kg) | 155 lbs. (70 kg) | 180 cm |
| 155 lbs. (70 kg) | 185 lbs. (84 kg) | 190 cm |
| 185 lbs. (84 kg) | 260 lbs. (118 kg) | 200 cm |

It should also be pointed out that one skilled in estimating the weight of people could determine the appropriate encrypted user weight indicator without the need for other equipment to select the appropriate ski.

The above description of various ski selection systems not only discloses structure for a system, but also describes a method of selection. In the practicing the method, there is a deterministic mode, where no interaction with the user is sought beyond information relating to the weight of the user. This is the mode employed in the embodiments shown in FIGS. 1 through 4. There is also a more inclusive mode, in which other information is considered under certain conditions to help the user refine his/her selection. This mode is employed in the embodiments shown in FIGS. 5 through 7.

In all cases, a set of user weight ranges are defined such that they map onto the range of weights of anticipated skiers. These ranges may vary in size, and frequently have the lowest weight range and the highest weight range extended to limit the number of weight ranges required to cover the range of anticipated weights. A set of encrypted user weight indicators is established, the user weight indicators corresponding to the defined user weight ranges.

A collection of skis is provided, the skis being prequalified manufactured skis sorted into groups which each corresponds to one of the defined user weight ranges. A collection of distinct ski indicia is provided, the ski indicia each corresponding to one of the encrypted user weight indicators. Frequently, both the ski indicia and the corresponding encrypted user weight indicators are color coded; however, a shared symbol or icon could be used. Alternatively, the distinct ski indicia can be the ski length, in which case the encrypted weight indicator is a number which expresses the ski length. In all cases, the ski indicia are assigned to the skis so as to identify the skis belonging to each group. The distinct ski indicia can be applied to the skis or to packaging therefor so as to be consistent with the encrypted user weight indicators such that, by selecting skis marked with the ski indicia which match the encrypted user weight indicator for the user weight range containing the weight of the user, the skis so selected are suitable for the weight of the user. Preferably, the indicia are applied to the skis themselves, so that each ski is appropriately marked.

To select the suitable encrypted user weight indicator to which the ski indicia are to be matched, the unannounced weight of the user is accessed without disclosing the weight to others. The unannounced weight is then assigned into the appropriate one of the user weight ranges, for which the corresponding encrypted user weight indicator is identified. This can be done by the user viewing a reference chart or by other techniques such as described above.

A pair of skis is then selected, in which each of the skis is associated with the distinct ski indicia that match the identified encrypted user weight indicator, to provide an appropriate pair of skis for the user based on the weight of the user.

When either the size of the user weight ranges is large or there is a desire to tune the selection to a profile of a particular user, the selection process can be refined by selecting sub-ranges of the user weight ranges which are directly correlated to the encrypted user weight indicators, and provide buffer regions between the sub-ranges of adjacent user weight ranges. No encrypted user weight indicators are provided for the buffer regions. For users having a weight which falls within one of the buffer regions between the sub-ranges, instructional material is provided to assist the user in choosing which of the two bordering encrypted user weight indicators should be used to select skis having matching ski indicia.

While the novel features of the present invention have been described in terms of particular embodiments and preferred applications, it should be appreciated by one skilled in the art that substitution of materials and modification of details obviously can be made without departing from the spirit of the invention.

What is claimed is:

1. A method for allowing a user having a weight within an anticipated range of user weights to select a ski having suitable characteristics to match the weight of the user, the method comprising the steps of:

defining a set of user weight ranges, said user weight ranges being defined so as to collectively map onto the anticipated range of user weights;

establishing a set of geometric shapes, each of which corresponds to one of said user weight ranges;

providing a collection of skis which are sorted into groups, each of the skis in a particular group having performance characteristics suitable for users having a weight which falls within a particular one of said user weight ranges;

providing a set of ski indicia matched in visual appearance with said geometric shapes;

associating the ski indicia with each ski in the group of skis having performance characteristics suitable for users having a weight which falls within the one of said user weight ranges that corresponds to the one of said geometric shapes which matches that particular one of the ski indicia;

assessing the weight of the user without publicly providing a common numeric indication of weight or mass;

assigning said assessed user weight into an appropriate one of said user weight ranges and identifying to the user the one of said geometric shapes which corresponds to the one of said user weight ranges into which said assessed user weight is assigned; and selecting a pair of skis associated with ski indicia which match said identified one of said geometric shapes.

2. The method of claim 1 wherein said step of assessing the weight of the user further comprises the step of:

providing a known weight of the user; and further wherein said step of assigning said assessed user weight and identifying the corresponding one of said geometric shapes further comprises the steps of:

providing a reference chart marked with the limits of each of said weight ranges and with said corresponding geometric shapes for each of said user weight ranges;

comparing the known weight of the user to said marked limits to determine within which of said user weight ranges the known weight of the user falls; and using said reference chart to identify the one of said geometric shapes which corresponds to said determined weight range.

3. The method of claim 1 wherein said step of assessing the weight of the user comprises the step of:

weighing the user on a weighing station; and further wherein said step of assigning said assessed user weight and identifying the corresponding one of said geometric shapes further comprises the step of:

displaying on the weighing station the one of said geometric shapes that corresponds to the one of said user weight ranges which includes the weight of the user.

4. The method of claim 1 wherein the step of establishing a set of encrypted user weight indicators is done such that said geometric shapes for each of said user weight ranges corresponds to a sub-range of that particular user weight range, and further wherein said step of assigning said assessed user weight and identifying the corresponding one of said geometric shapes further comprises the step of:

if none of said encrypted user weight indicators corresponds to said assessed user weight, providing a query to the user to aid in selecting an appropriate one of said geometric shapes.

5. The method of claim 4, wherein said step of assessing the weight of the user further comprises the step of:

providing a known weight of the user; and further wherein said step of assigning said assessed user weight and identifying the corresponding one of said geometric shapes further comprises the steps of:

providing a reference chart marked with the limits of each of said weight ranges and with said corresponding geometric shapes for each of said user weight ranges;

comparing said known weight of the user to said marked limits to determine within which of said user weight ranges said known weight of the user falls; and using said reference chart to identify the one of said geometric shapes which corresponds to said determined weight range.

6. The method of claim 4, wherein said step of assessing the weight of the user further comprises the step of:

weighing the user on a weighing station; and further wherein said step of assigning said assessed user weight and identifying the corresponding one of said geometric shapes further comprises the step of:

displaying on the weighing station the one of said geometric shapes that corresponds to the one of said user weight ranges which includes the weight of the user.

7. A ski selection system comprising:

a plurality of differing skis having differently colored labels thereon each having a designated color corresponding to one of a plurality of ranges of user weights suitable for each of the plurality of skis, the ranges of user weights spanning multiple weight measuring units;

a scale including a mechanism for obtaining a reading proportional to the weight of the user; and an indicator coupled to the mechanism and bearing differently colored regions corresponding to the colored labels, the mechanism actuating the indicator proportionally to the reading to indicate a selection of one of the colored regions corresponding to the weight of the user.

8. The ski selection system of claim 7, wherein the indicator includes a face and a pointer, the face having the colored regions secured thereto.

9. The ski selection system of claim 8, wherein the indicator face includes colored regions corresponding to colored labels for a plurality of series of skis.

10. The ski selection system of claim 8, wherein the indicator face includes at least one intermediate zone between colored regions.

* * * * *